US007434576B2

(12) United States Patent
Hwang

(10) Patent No.: US 7,434,576 B2
(45) Date of Patent: Oct. 14, 2008

(54) CUTTING APPARATUS FOR CUTTING TILES

(76) Inventor: Horng-Jann Hwang, No. 123, Dasing 21st St., Taiping City, Taichung Hsien (TW)

( * ) Notice: Subject to any disclaimer, the term of this patent is extended or adjusted under 35 U.S.C. 154(b) by 85 days.

(21) Appl. No.: 11/561,835

(22) Filed: Nov. 20, 2006

(65) Prior Publication Data

US 2008/0115643 A1 May 22, 2008

(51) Int. Cl.
*B28D 1/24* (2006.01)

(52) U.S. Cl. ..... 125/23.02; 225/96.5

(58) Field of Classification Search ..... 33/403, 33/526, 527, DIG. 30; 83/468.3; 125/12, 125/13.01, 14, 23.02; 225/96.5
See application file for complete search history.

(56) References Cited

U.S. PATENT DOCUMENTS 3,964,360 A * 6/1976 Schwartz ..... 83/464
D331,762 S * 12/1992 Matt ..... D15/127
5,169,045 A * 12/1992 Liu ..... 225/96.5
5,480,081 A * 1/1996 Wilson et al. ..... 225/96.5
5,483,749 A * 1/1996 Hepworth ..... 33/527
5,615,665 A * 4/1997 Thiriet ..... 125/23.02
6,053,159 A * 4/2000 Liu ..... 125/23.02
D434,782 S * 12/2000 Comas ..... D15/127
6,644,156 B2 * 11/2003 Villacis ..... 83/425

* cited by examiner

*Primary Examiner*—Timothy V Eley
(74) *Attorney, Agent, or Firm*—patenttm.us

(57) ABSTRACT

A cutting apparatus for cutting tiles has a base, a rail device, a cutting device, a positioning ruler and a clamping apparatus. The base has an elongated slot defined near the distal end of the base and having a setscrew hole. The rail device is connected to the base. The cutting device is connected to the base and has a mounting bracket, an operating shaft and a cutter. The mounting bracket is connected movably to the rail device. The operating shaft is connected pivotally to the mounting bracket. The cutter is connected to the operating shaft. The positioning ruler is mounted movably on the base. The clamping apparatus is connected securely to the base and has two connecting brackets, a handle and two pressing elements.

6 Claims, 7 Drawing Sheets

CUTTING APPARATUS FOR CUTTING TILES

BACKGROUND OF THE INVENTION

1. Field of the Invention

The present invention relates to a cutting apparatus, and more particularly relates to a cutting apparatus that can cut tiles quickly and precisely.

2. Description of Related Art

With reference to FIGS. 6 and 7, a conventional cutting apparatus for cutting a tile (80) has a base (70), a cutting device (73) and a positioning ruler (74).

The base (70) has two ends, a top, an elongated slot (701), two supports (71) and two rail-posts (72). The supports (71) are formed respectively on the ends of the base (70). The elongated slot (701) is formed in the top near one of the ends of the base (70) and has a bottom. The rail-posts (72) are connected between the supports (71) over the top of the base (70), are parallel with each other and are perpendicular to the elongated slot (701).

The cutting device (73) is connected to the base (70) and has a mounting bracket (731), an operating shaft (732) and a cutter (733). The mounting bracket (731) is connected movably to the rail-posts (72) over the base (70). The operating shaft (732) is connected pivotally to the mounting bracket (731) and extends toward the end of the base (70) opposite to the elongated slot (701). The cutter (733) is connected to the operating shaft (732).

The positioning ruler (74) is L-shaped, is mounted movably on the base (70) and has a sliding segment (741) and a contacting segment (742). The sliding segment (741) is mounted movably in the elongated slot (701) and has a top, an elongated hole (743), two fasteners (75) and a scale.

The elongated hole (743) is formed through the sliding segment (741) of the positioning ruler (74). The fasteners (75) are extended through the elongated hole (743) and are screwed into the bottom of the elongated slot (701) to fasten the positioning ruler (74) in the elongated slot (701). The contacting segment (742) is connected perpendicularly to the sliding segment (741) and is located between the ends of the base (70). The scale is mounted on the top in the sliding segment (741) of the positioning ruler (74).

With reference to FIG. 7, when the conventional cutting apparatus cuts a tile (80), the tile (80) is put on the top of the base (70) and contacts with the contacting segment (742) of the positioning ruler (74). Then, adjusting a cutting line of the tile (80) to aim at the cutter (733) by loosening the fasteners (75) and moving the sliding segment (741) of the positioning ruler (74) relative to the elongated slot (701) in the base (70).

When the cutting line of the tile (80) is aimed at the cutter (733) by the scale on the top of the sliding segment (741), the fasteners (75) are fastened to connect the sliding segment (741) securely with the bottom of the elongated slot (701). Then, the operating shaft (732) is pressed and moved with the mounting bracket (73) relative to the rail-posts (72) to cut the tile (80) with the cutter (733).

However, the fasteners (75) on the conventional cutting apparatus must be loosen and fastened for adjusting the location of the tile (80) and the conventional cutting apparatus is inconvenient and time-consuming in use.

Therefore, the present invention provides a cutting apparatus for cutting tiles to mitigate or obviate the aforementioned problems.

SUMMARY OF THE INVENTION

The main objective of the present invention is to provide a cutting apparatus for cutting tiles and that can cut tiles quickly and precisely.

The cutting apparatus for cutting tiles has a base, a rail device, a cutting device, a positioning ruler and a clamping apparatus. The base has an elongated slot defined near the distal end of the base and having a setscrew hole. The rail device is connected to the base over the top. The cutting device is connected to the base and has a mounting bracket, an operating shaft and a cutter. The mounting bracket is connected movably to the rail device. The operating shaft is connected pivotally to the mounting bracket. The cutter is connected to the operating shaft. The positioning ruler is mounted movably on the base. The clamping apparatus is connected securely to the base and has two connecting brackets, a handle and two pressing elements.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
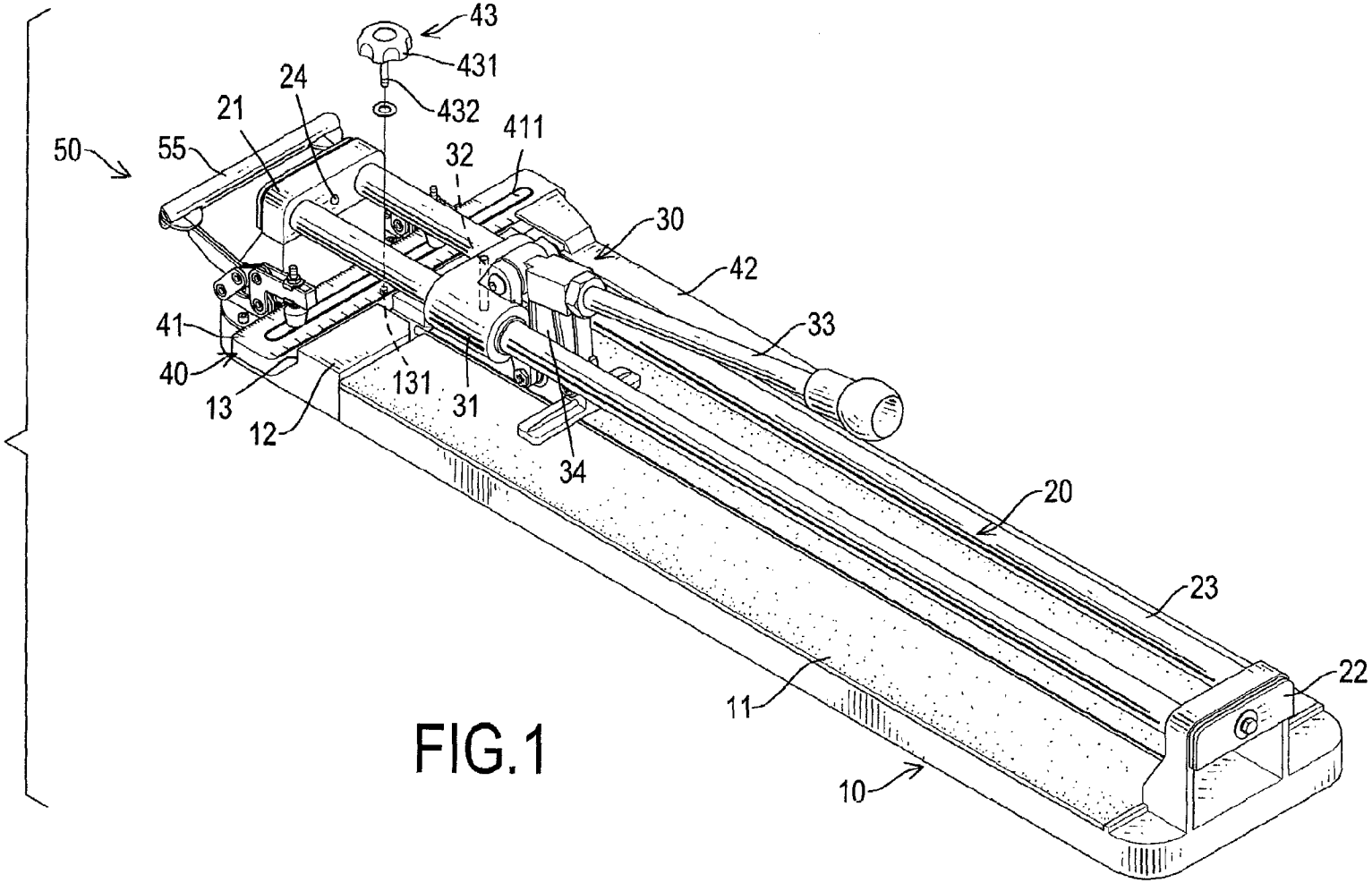
FIG. 1 is a perspective view of a cutting apparatus for cutting tiles in accordance with the present invention.
Figure 2:
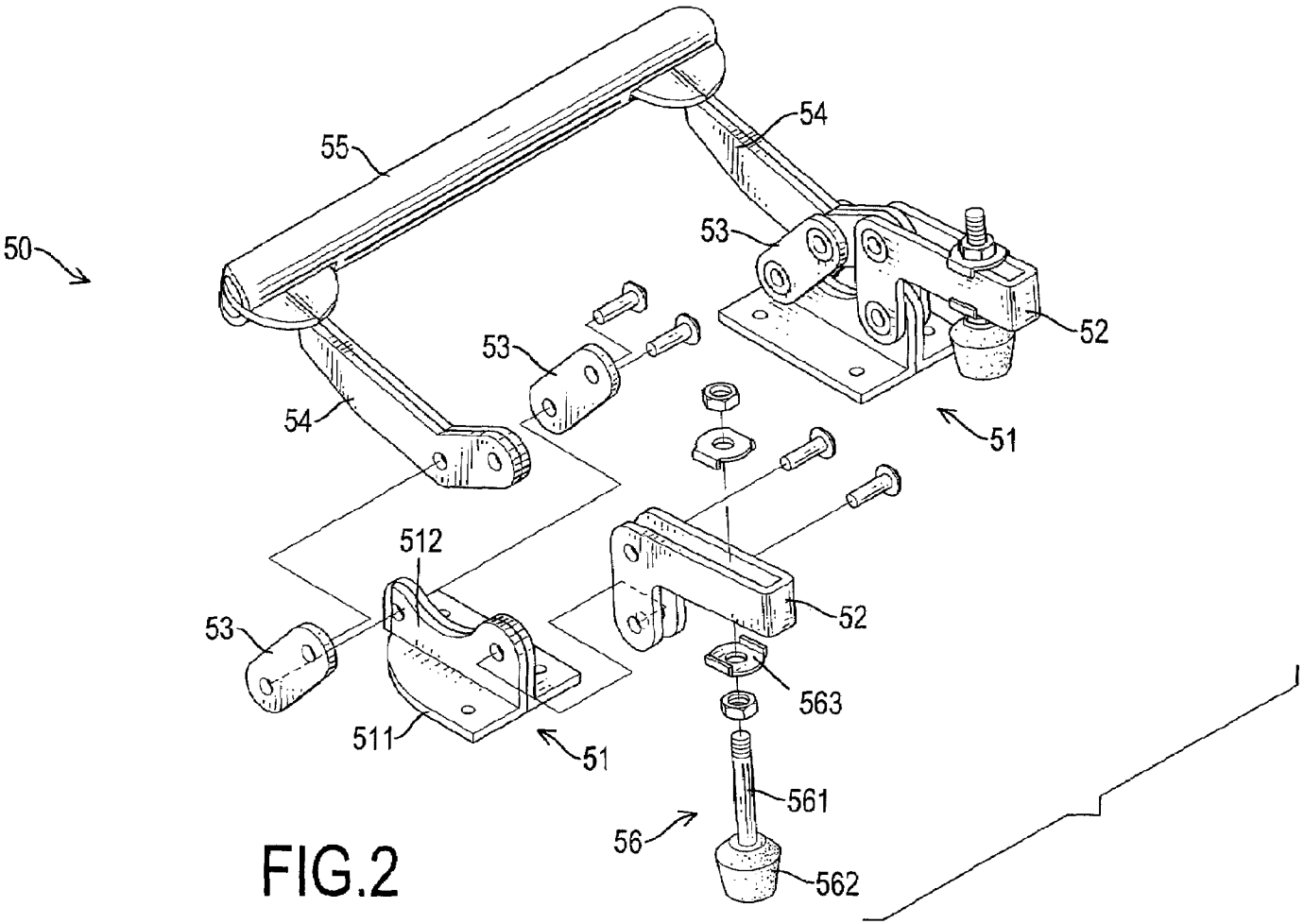
FIG. 2 is an enlarged exploded perspective view of the clamping apparatus of the cutting apparatus in FIG. 1.
Figure 3:
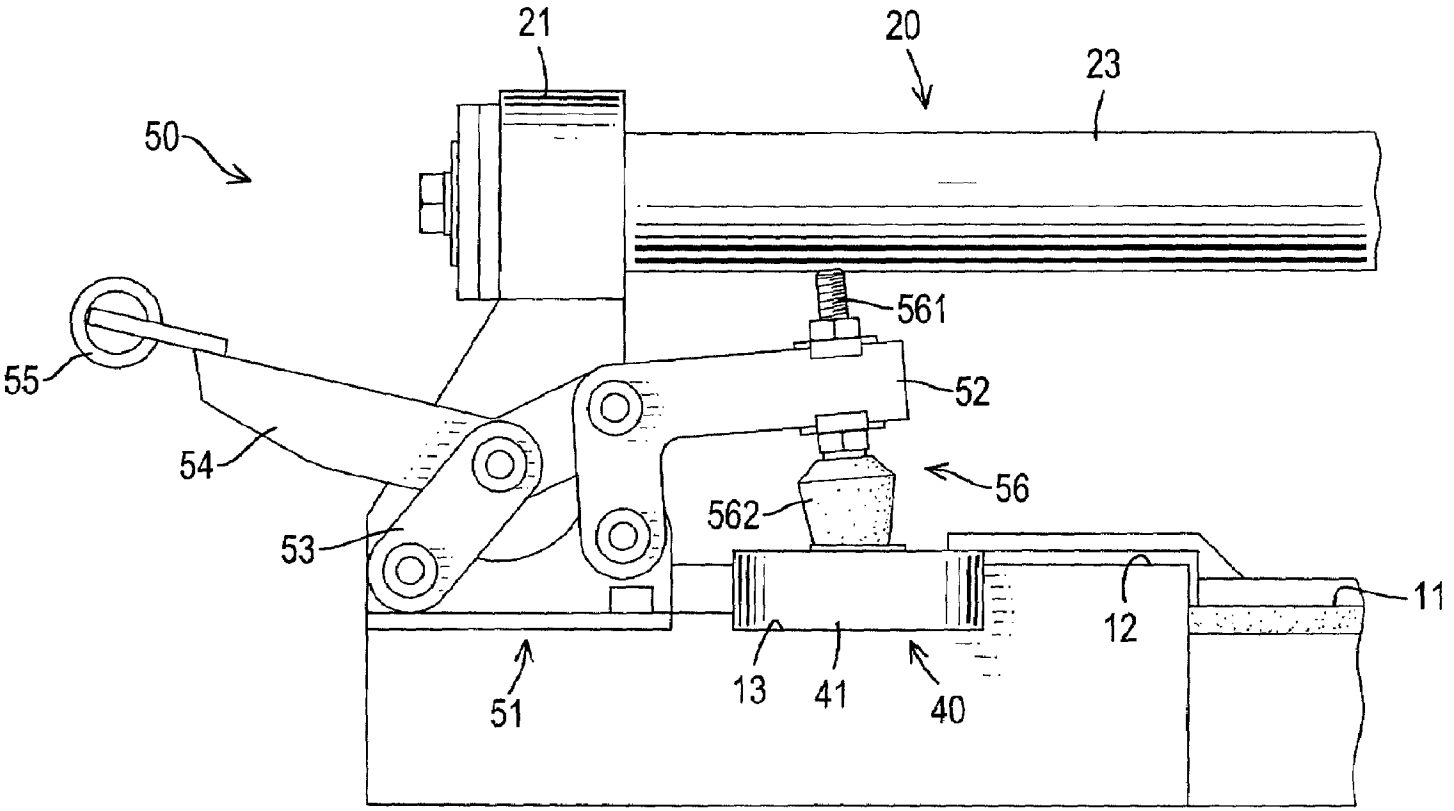
FIG. 3 is an enlarged side view of the clamping apparatus in FIG. 2.
Figure 4:
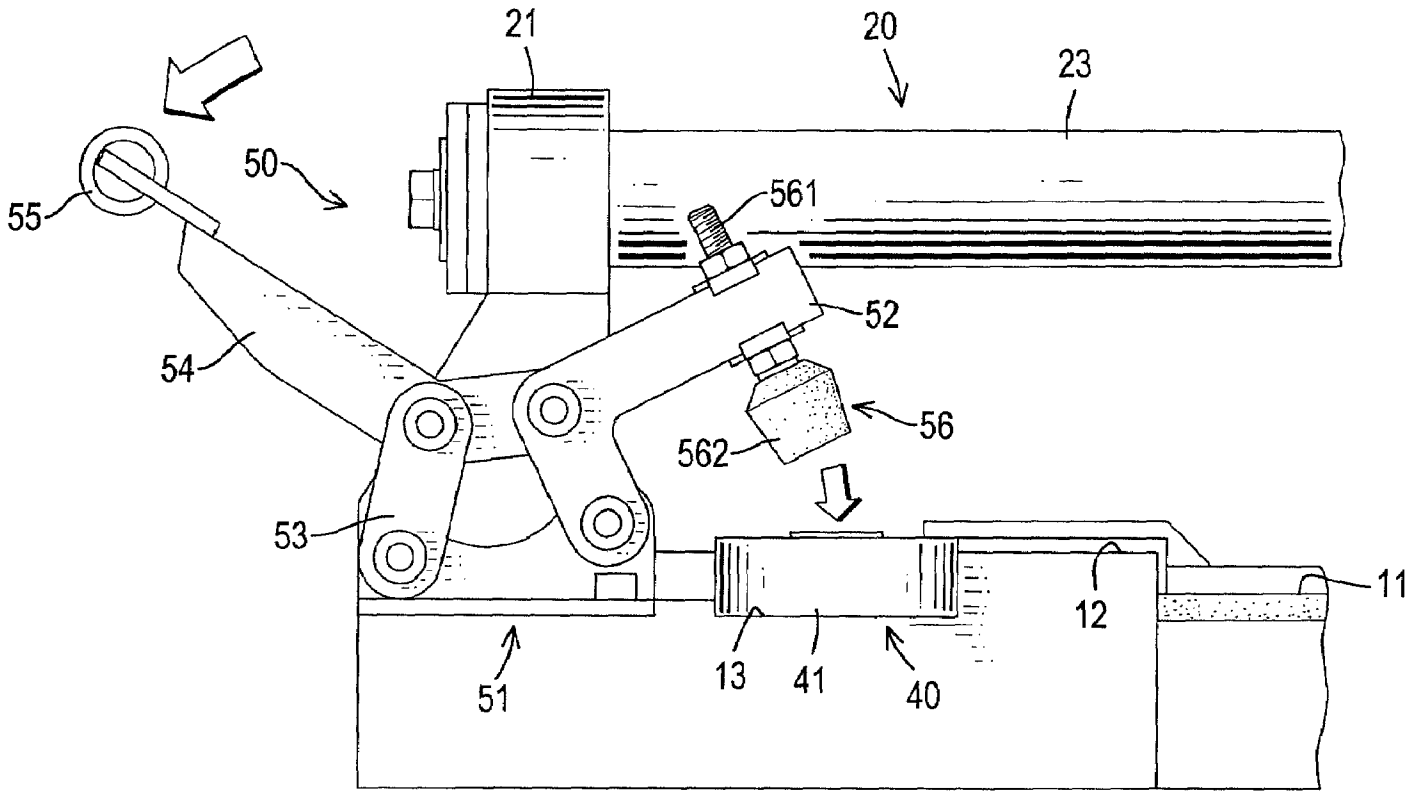
FIG. 4 is an operational side view of the clamping apparatus in FIG. 3.
Figure 5:
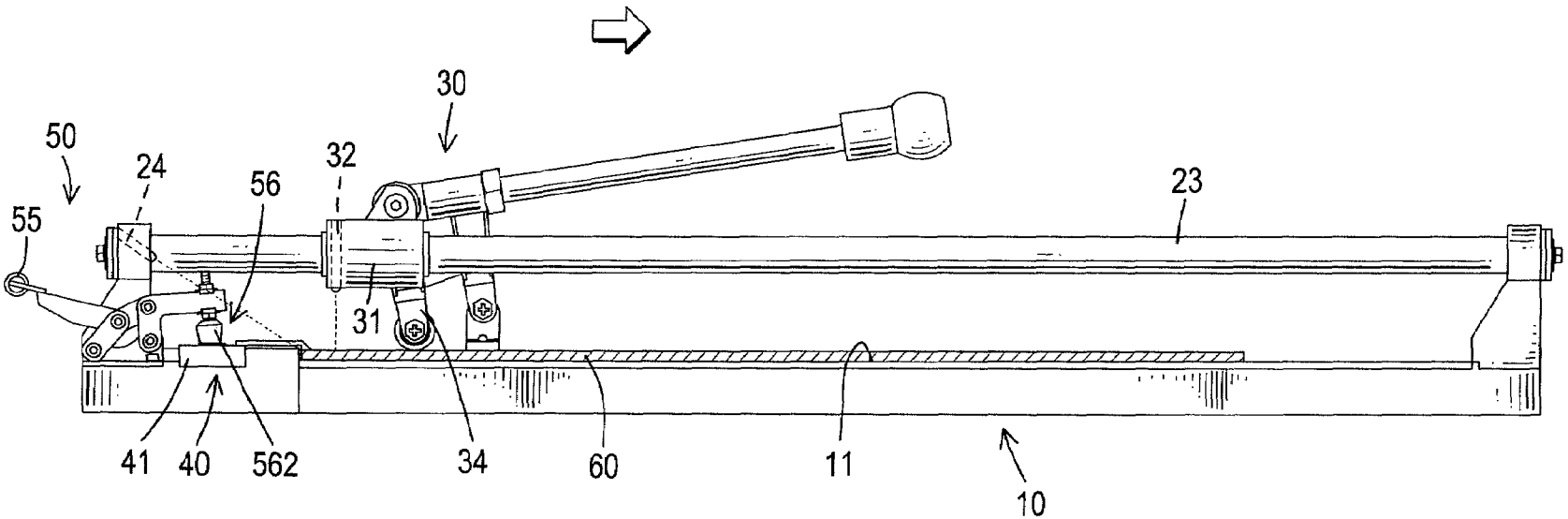
FIG. 5 is an operational side view of the clamping apparatus in FIG. 1.
Figure 6:
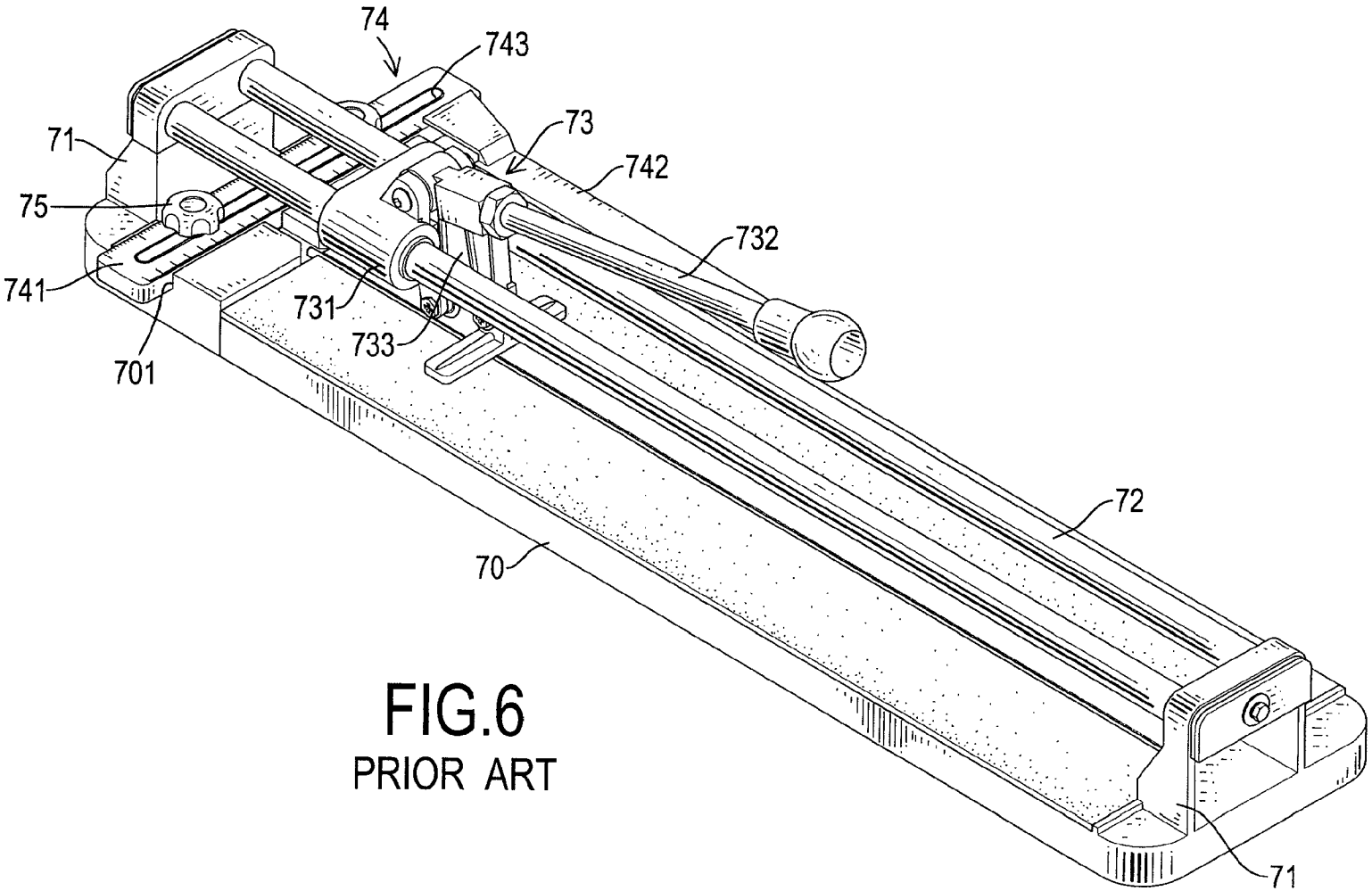
FIG.6 PRIOR ART
FIG. 6 is a perspective view of a conventional cutting apparatus in accordance with the prior art.
Figure 7:
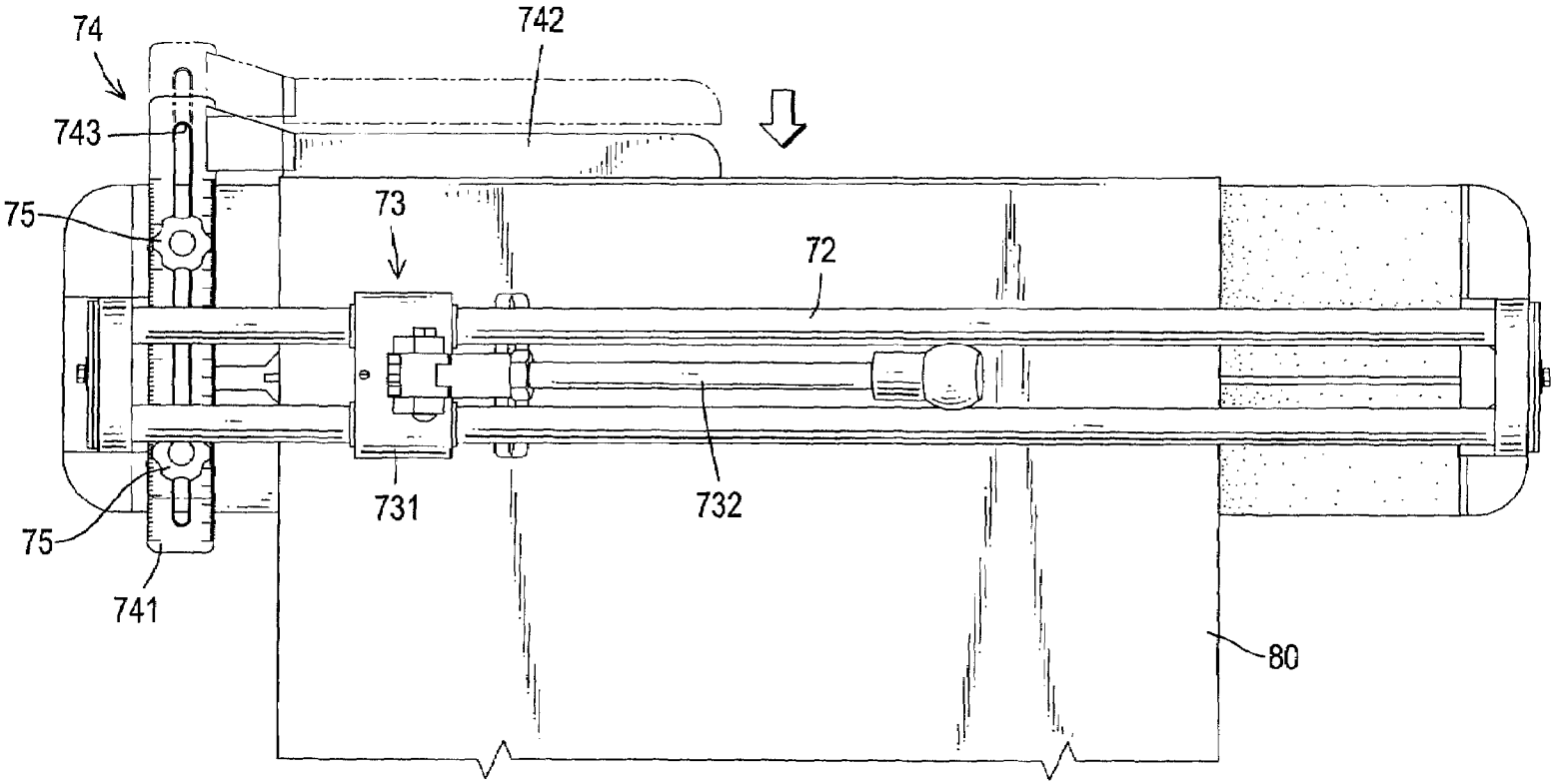
FIG.7 PRIOR ART
FIG. 7 is an operational top view of the conventional cutting apparatus in FIG. 6.

With reference to FIGS. 1 to 3, a cutting apparatus in accordance with the present invention for cutting tiles comprises a base (10), a rail device (20), a cutting device (30), a positioning ruler (40) and a clamping apparatus (50).

The base (10) may be rectangular and has a top (11), a proximal end, a distal end (12) and an elongated slot (13). The elongated slot (13) is defined near the distal end (12) of the base (10) and has a bottom and a setscrew hole (131). The setscrew hole (131) is formed in the bottom of the elongated slot (13).

The rail device (20) is connected to the base (10) over the top (11) and has a first support (21), a second support (22) and two rail-posts (23). The first support (21) is formed on the distal end (12) of the base (10) near the elongated slot (13) and has a sidewall and a first laser device (24). The sidewall of the first support (21) is defined near the elongated slot (13). The first laser device (24) is mounted slantwise in the first support (21) and can emit a laser light onto the top (11) of the base (10). The second support (22) is formed on the proximal end of the base (10) opposite to the elongated slot (13). The rail-posts (23) are connected between the supports (21, 22) over the top (11) of the base (10), are parallel to each other and are perpendicular to the elongated slot (13).

The cutting device (30) is connected to the base (10) and has a mounting bracket (31), an operating shaft (33) and a cutter (34). The mounting bracket (31) is connected movably to the rail-posts (23) of the rail device (20) over the top (11) of the base (10) and has a second laser device (32). The second laser device (32) is mounted in the mounting bracket (31) and can emit a laser light perpendicular to the top (11) of the base (10).

The operating shaft (33) is connected pivotally to the mounting bracket (31) between the rail-posts (23) and extends toward the proximal end of the base (10) to oppositely the elongated slot (13). The cutter (34) is connected to the operating shaft (33) and faces the top (11) of the base (10). When the cutter (34) is moved with the operating shaft (33), the cutter (34) can be moved along the laser lights of the first laser device (24) and the second laser device (32).

The positioning ruler (40) may be L-shaped, is mounted movably on the base (10) and has a sliding segment (41) and a contacting segment (42). The sliding segment (41) is mounted movably in the elongated slot (13) and has a top, an elongated hole (411), a fastener (43) and a scale. The elongated hole (411) is formed through the sliding segment (41) of the positioning ruler (40) and is aligned with the setscrew hole (131) in the bottom of the elongated slot (13).

The fastener (43) is connected to the positioning ruler (40) and the elongated slot (13) of the base (10) and has a top, a bottom, a rotating button (431) and a threaded post (432). The rotating button (431) is formed on the top of the fastener (43) and contacts with the top of the sliding segment (41) of the positioning ruler (40). The threaded post (432) is formed on the bottom of the fastener (43), is attached to the rotating button (431), extends through the elongated hole (411) and is screwed into the setscrew hole (131) in the elongated slot (13) to fasten the sliding segment (41) of the positioning ruler (40) on the base (10). The scale is mounted on the top of the sliding segment (41) of the positioning ruler (40).

The contacting segment (42) is connected perpendicularly to the sliding segment (41) of the positioning ruler (40) between the distal end (12) and the proximal end of the base (10).

The clamping apparatus (50) is connected securely to the base (10) and has two connecting brackets (51), a handle (55) and two pressing elements (56). The connecting brackets (51) may be T-shaped, are connected to the distal end (12) of the base (10) and are located respectively at two sides of the first support (21). Each connecting bracket (51) has a horizontal segment (511), a vertical segment (512), an extending frame (52), two connecting beams (53) and two mounting beams (54).

The horizontal segment (511) of the connecting bracket (51) is mounted on the distal end (12) of the base (10). The vertical segment (512) of the connecting bracket (51) is formed on the horizontal segment (511) and has an inner end and an outer end. The extending frame (52) may be L-shaped and is connected pivotally to the vertical segment (512) and has a lower end, an upper end and a turning segment.

The lower end of the extending frame (52) is connected pivotally to the inner end of the vertical segment (512). The upper end of the extending frame (52) extends over the positioning ruler (40). The turning segment of the extending frame (52) is defined between the lower end and the upper end. The connecting beams (53) are connected pivotally to the outer end of the vertical segment (512) of the connecting bracket (51). The mounting beam (54) may be V-shaped, is connected pivotally to the turning segment of the extending frame (52) and the connecting beams (53).

The handle (55) is connected to an end of the mounting beams (54) of the connecting bracket (51) opposite to the connecting beams (53). The pressing elements (56) are connected respectively to the connecting brackets (51) and selectively press against the positioning ruler (40), and each pressing element (56) has two connecting gaskets (563), a pressing shaft (561) and a pressing block (562). The connecting gaskets (563) are mounted on the extending frame (52) and each connecting gasket (536) has a through hole. The pressing shaft (561) extends through the through holes of the connecting gaskets (536), is connected to the extending frame (52), is adjacent to the positioning ruler (40) and has a lower end. The pressing block (562) is mounted on the lower end of the pressing shaft (561) and can press against the sliding segment (41) of the positioning ruler (40).

With reference to FIGS. 1 to 5, when the cutting apparatus is used to cut a tile (60), the handle (55) of the clamping apparatus (50) is lifted up and pivots the extending frames (52) with the transmission of the connecting beams (53) and the mounting beams (54). The upper ends of the extending frames (52) are pivoted upward and the pressing blocks (562) of the pressing elements (56) is moved away from the sliding segment (41) of the positioning ruler (40).

After lifting the handle (55), the fasteners (43) are loosened and the sliding segment (41) of the positioning ruler (40) is moved along the elongated slot (13) in the base (10). Then, the tile (60) is put on the top (11) of the base (10) and abuts with the contacting segment (42) of the positioning ruler (40). Consequently, the position of the tile (60) is adjusted to aim a desired cutting line on the tile (60) at the laser lights emitting from the laser devices (24, 32) to locate the cutting line on the tile (60) at a precise position.

When the handle (55) is pressed downward, the pressing blocks (562) of the pressing elements (56) abut against the sliding segment (41) of the positioning ruler (40) and the fastener (43) are fastened to connect the sliding segment (41) securely with the bottom of the elongated slot (13). Accordingly, the tile (34) is cut by the cutter (34) along the precise cutting line by means of pressing and moving the operating shaft (33) with the mounting bracket (31) along the rail-posts (23).

The cutting apparatus for cutting tiles has the following advantages.

1. Users can lift and down the handle (55) to make the pressing elements (56) moving away and contacting against the sliding segment (41) of the positioning ruler (40) to the elongated slot (13) in the base (10) and only one fastener (43) are needed to be fastened and loosened. Therefore, cutting the tile (60) with the cutting apparatus is easy and quickly.

2. Users can cut the tile (60) precisely and conventionally in cooperation with the laser lights emitting from the laser devices (24, 32) and the cutter (34).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cutting apparatus for cutting tiles comprising a base being rectangular and having a top;

a proximal end;

a distal end; and an elongated slot being defined near the distal end of the base;

a rail device being connected to the base over the top and having a first support being formed on the distal end of the base near the elongated slot;

a second support being formed on the proximal end of the base opposite to the elongated slot; and two rail-posts being connected between the supports over the top of the base, being parallel to each other and being perpendicular to the elongated slot;

a cutting device being connected to the base and having a mounting bracket being connected movably to the rail device over the top of the base;

an operating shaft being connected pivotally to the mounting bracket and extending toward the proximal end of the base opposite to the elongated slot; and a cutter being connected to the operating shaft and facing the top of the base;

a positioning ruler being mounted movably on the elongated slot of the base; and a clamping apparatus being connected securely to the base and having two pressing elements selectively pressed against the positioning ruler; and two connecting brackets being T-shaped, being connected to the distal end of the base and each connecting bracket having a horizontal segment being mounted on the distal end of the base;

a vertical segment being formed on the horizontal segment and having an inner end; and an outer end;

an extending frame being L-shaped, being connected pivotally to the vertical segment of the connecting bracket and having a lower end being connected pivotally to the inner end of the vertical segment of the connecting bracket;

an upper end extending over the positioning ruler, and a turning segment being defined between the lower end and the upper end;

two connecting beams being connected pivotally to the outer end of the vertical segment of the connecting bracket; and two mounting beams being V-shaped, being connected to the turning segment of the extending frame and the connecting beams; and a handle being connected to the mounting beams of the connecting bracket at ends of the mounting beams opposite to the connecting beams and the extending frame.

2. The cutting apparatus for cutting tiles as claimed in claim 1, wherein the pressing elements are connected to the connecting brackets, and each pressing element has two connecting gaskets being mounted on a corresponding one of the extending frames and each connecting gasket having a through hole;

a pressing shaft extending through the through holes of the connecting gaskets, being connected to the corresponding extending frame, being adjacent to the positioning ruler and having a lower end; and a pressing block being mounted on the lower end of the pressing shaft and selectively pressing against the sliding segment of the positioning ruler.

3. The cutting apparatus for cutting tiles as claimed in claim 2, wherein the elongated slot has a bottom; and a setscrew hole being formed in the bottom of the elongated slot; and the positioning ruler is L-shaped, is mounted movably on the base and has a sliding segment being mounted movably in the elongated slot and having a top;

an elongated hole being formed through the sliding segment and being aligned with the setscrew hole in the bottom of the elongated slot;

a fastener being connected to the positioning ruler and the elongated slot of the base and having a top;

a bottom;

a rotating button being formed on the top of the fastener and contacting with the top of the sliding segment of the positioning ruler; and a threaded post being formed on the bottom of the fastener, being to the rotating button, extending through the elongated hole and being screwed into the setscrew hole in the elongated slot to fasten the sliding segment of the positioning ruler with the base; and a scale being mounted on the top of the sliding segment of the positioning ruler; and a contacting segment being connected perpendicularly to the sliding segment of the positioning ruler between the distal end and the proximal end of the base.

4. The cutting apparatus for cutting tiles as claimed in claim 3, wherein the first support has a sidewall being defined near the elongated slot; and a first laser device being mounted slantwise in the first support for emitting a laser light onto the top of the base; and the mounting bracket further has a second laser device being mounted in the mounting bracket and emitted a laser light perpendicular on the top of the base.

5. The cutting apparatus for cutting tiles as claimed in claim 1, wherein the elongated slot has a bottom; and a setscrew hole being formed in the bottom of the elongated slot; and the positioning ruler is L-shaped, is mounted movably on the base and has a sliding segment being mounted movably in the elongated slot and having a top;

an elongated hole being formed through the sliding segment and being aligned with the setscrew hole in the bottom of the elongated slot;

a fastener being connected to the positioning ruler and the elongated slot of the base and having a top;

a bottom;

a rotating button being formed on the top of the fastener and contacting with the top of the sliding segment of the positioning ruler; and a threaded post being formed on the bottom of the fastener, being connected to the rotating button, extending through the elongated hole and being screwed into the setscrew hole in the elongated slot to fasten the sliding segment of the positioning ruler with the base; and a scale being mounted on the top of the sliding segment of the positioning ruler; and a contacting segment being connected perpendicularly to the sliding segment of the positioning ruler between the distal end and the proximal end of the base.

6. The cutting apparatus for cutting tiles as claimed in claim 1, wherein the first support has a sidewall being defined near the elongated slot; and a first laser device being mounted slantwise in the first support for emitting a laser light onto the top of the base; and the mounting bracket further has a second laser device being mounted in the mounting bracket for emitting a laser light perpendicular on the top of the base.

* * * * *